US009312651B2

(12) United States Patent
Hsiang

(10) Patent No.: US 9,312,651 B2
(45) Date of Patent: Apr. 12, 2016

(54) PLUG SET PROVIDED WITH SPATIAL VARIATION

(71) Applicant: Chien-Heng Hsiang, New Taipei (TW)

(72) Inventor: Chien-Heng Hsiang, New Taipei (TW)

( * ) Notice: Subject to any disclaimer, the term of this patent is extended or adjusted under 35 U.S.C. 154(b) by 0 days.

(21) Appl. No.: 14/419,177

(22) PCT Filed: Jul. 26, 2013

(86) PCT No.: PCT/CN2013/080152
§ 371 (c)(1),
(2) Date: Feb. 2, 2015

(87) PCT Pub. No.: WO2014/023164
PCT Pub. Date: Feb. 13, 2014

(65) Prior Publication Data

US 2015/0194777 A1 Jul. 9, 2015

(30) Foreign Application Priority Data

Aug. 7, 2012 (CN) ..... 2012 2 0388536

(51) Int. Cl.
*H01R 31/06* (2006.01)
*H01R 24/62* (2011.01)
*H01R 13/627* (2006.01)
*H01R 13/6582* (2011.01)

(52) U.S. Cl.
CPC ..... *H01R 31/06* (2013.01); *H01R 13/6275* (2013.01); *H01R 13/6582* (2013.01); *H01R 24/62* (2013.01)

(58) Field of Classification Search
CPC .... H01R 31/06; H01R 13/6582; H01R 24/60; H01R 24/62
See application file for complete search history.

(56) References Cited

U.S. PATENT DOCUMENTS 5,637,018 A 6/1997 Gargiulo
8,512,064 B1 * 8/2013 Kwankijpongsa ..... H01R 31/06 439/374
8,790,125 B1 * 7/2014 Lee ..... H01R 13/447 439/131
8,870,601 B2 * 10/2014 Lee ..... H01R 31/06 439/131
8,905,653 B2 * 12/2014 Wu ..... G02B 6/3817 385/93
8,936,489 B2 * 1/2015 Liao ..... H01R 27/02 439/638
8,979,598 B2 * 3/2015 Liao ..... H01R 13/447 439/730
8,986,032 B2 * 3/2015 Liao ..... H01R 13/44 439/304
9,160,124 B2 * 10/2015 Colahan ..... H01R 13/6315
9,184,545 B2 * 11/2015 Chen ..... H01R 31/06
2007/0267696 A1 * 11/2007 Liao ..... H01R 31/06 257/347
2014/0106623 A1 * 4/2014 Wu ..... H01R 27/00 439/638
2014/0273613 A1 * 9/2014 McSweyn ..... H01R 27/00 439/518

(Continued)

FOREIGN PATENT DOCUMENTS

CN 101039004 A 9/2007
CN 202792540 U 3/2013

(Continued)

*Primary Examiner* — Ross Gushi
(74) *Attorney, Agent, or Firm* — Muncy, Geissler, Olds & Lowe, P.C.

(57) ABSTRACT

A plug set that consists of an adapter, which is provided with a mouth socket, a cantilevered tongue, a plurality of horizontally disposed terminals, a swivel connector, and a movable connected device. The plug set uses the mouth socket provided on the adapter to enable assembling the swivel connector to the adapter through a swiveling motion, thereby achieving electrical contact and an antimagnetic effect, and the antimagnetic components are used to carry out wedge positioning. Moreover, both the adapter and the swivel connector can be used independently after separation.

9 Claims, 11 Drawing Sheets

(56) References Cited

U.S. PATENT DOCUMENTS

2014/0273644 A1* 9/2014 McSweyn ..... H01R 27/00 439/628
2014/0335709 A1* 11/2014 Chung ..... H01R 31/06 439/172
2015/0087185 A1* 3/2015 Chang ..... H01R 31/06 439/607.01
2015/0194777 A1* 7/2015 Hsiang ..... H01R 24/62 439/351
2015/0214684 A1* 7/2015 Chen ..... H01R 35/04 439/217

FOREIGN PATENT DOCUMENTS

TW I303905 B 12/2008
TW M447610 U1 2/2013

* cited by examiner

PLUG SET PROVIDED WITH SPATIAL VARIATION

BACKGROUND OF THE INVENTION (a) Field of the Invention

The present invention relates to a plug set provided with spatial variation, and more particularly to a plug set that provides at least two types of female terminal specifications which are able to separately operate electrical plugs.

(b) Description of the Prior Art

Regarding electrical connections, especially when the connections are used for transmitting information signals, such as connections using an USB (Universal Serial Bus), etc., in which the male and female terminals are respectively provided with a plurality of corresponding conducting strips that enable forming an electrical conduction after mutual contact. As shown in FIG. 1, the periphery of a general USB base 1 is an insertion surround 10 that provides mechanical protection and antimagnetic effectiveness. The interior of the USB base 1 uses a cantilever method to longitudinally extend an insulating cantilevered plate 11. The upper surface of the cantilevered plate 11 is mounted with a plurality of receiving terminals 110. Furthermore, the inner surface of the insertion surround 10 is inwardly fitted with resilient protruding press guides 111. The periphery of a male end connector 2 is surrounded by an antimagnetic surround 20. An insulating support plate 21 is assembled on the upper half of the antimagnetic surround 20, and a plurality of contact terminals 210 are mounted on the support plate 21 facing the cantilevered plate 11. Contact relationships are formed after pairing the contact terminals 210 with the receiving terminals 110. After longitudinally inserting the entire body of the male end connector 2 from the rear, the contact terminals 210 press contact the receiving terminals 110 and establish electrical conduction therebetween.

After assembling, the lower periphery of the antimagnetic surround 20 of the male end connector 2 supports the lower surface of the cantilevered plate 11. The peripheral structure force of the antimagnetic surround 20 is able to produce a pulling force through the lower periphery support of the wedging force of the lower surface of the cantilevered plate 11, which allows the contact terminals 210 to effectively make contact pressure on the receiving terminals 110 to ensure electrical conduction therebetween.

The periphery of the antimagnetic surround 20 is supported by the press guides 111 fitted in the interior of the base 1 to achieve secondary auxiliary placement that allows precise positioning of the male end connector 2, and makes it difficult for the male end connector 2 to break away from the base 1.

The above describes the assembled operating state after longitudinally connecting the aforementioned USB connector. In addition, because of the diversification of present information equipment, plugs of single specifications can not accommodate connection with different information equipment mounted with female terminals of different specifications. Hence, the concept of conversion was introduced, by which a design for a convertible plug providing different specifications was developed, such as Taiwan Patent No. I303905 that discloses a composite simple plug, and uses an insulated housing provided with an open groove on the upper portion thereof to expose a plurality of terminals in the interior of the groove. And one end of the groove is provided with a swiveling portion that enables pin connections of an Internet plug to swivel connect in the groove and allow a rotary movement. Moreover, the Internet plug is provided with a second swiveling portion for assembling to a first swiveling portion of the plug housing. A rotational combination relationship is used to enable the Internet plug to press contact the terminals in the interior of the groove and provide an electrical connection to achieve telecommunications transmission. Furthermore, the wall surface of the groove is provided with clamp ports, the function of which is to clamp into notches on two sides at the front end of the Internet plug, thereby enabling the Internet plug to be assembled to the plug housing and achieve clamp positioning.

The concept of the aforementioned invention uses a swivel connection means to enable an Internet plug to movable swivel connect in the groove of the plug housing and realize electrical conduction from an USB connector installed at an outer end of the plug housing to an electrically connected information equipment. After turning on the Internet plug, the Internet plug can be used independently as an Internet plug socket to plug into and realize an electrical connection. Furthermore, peripheral antimagnetic effectiveness is removed after assembling the Internet plug to the housing. And in order to allow the swivel radius of the Internet plug to press into the groove, the upper side of the groove positioned for the terminals of the upper side of a connector must be completely open.

After separating the Internet plug, the functional use of the aforementioned design enables the Internet plug to independently plug into a general, standard Internet plug socket for connection therewith. However, the housing is structured to only allow exclusive use with the aforementioned paired Internet plug, and can not be used with other external standard Internet plugs.

SUMMARY OF THE INVENTION

A primary object of the present invention lies in providing a plug set provided with spatial variation, which is basically a plug set with a composite structure of two types of specifications to enable accommodating female terminal connectors of different specifications according to needs, thereby providing a plug set able to respectively switch over electrical conduction accordingly.

In order to achieve the above object, the plug set provided with spatial variation of the present invention comprises: An adapter, which is provided with a mouth socket, and the interior of the mouth socket is provided with a cantilevered tongue. The upper surface of the cantilevered tongue is mounted with a plurality of horizontally disposed terminals. An interspace in a lower periphery is correspondingly fitted with an antimagnetic U-shaped semi-open surround, which forms a receiving terminal set. And the mouth socket is outwardly mounted with conversion terminal. The conversion terminal and the aforementioned horizontally disposed terminals allow for electrical conduction. A swivel connector, one end of which is connected to a cable, and the free end is mounted with a plurality of surface connection terminals able to provide contact connection. The surface connection terminals allow for electrical conduction from the cable, and the periphery of the upper portion of the surface connection terminals is covered by an inverted U-shaped antimagnetic cover to form a press contact terminal set. Two sides of the antimagnetic cover are wedging plates. A movable connected device, which is installed at the end of side extension plates of the mouth socket. The movable connected device is movable connected to the base of the swivel connector, thereby enabling the swivel connector to perform a swivel action to assemble to and disassemble from the mouth socket of the adapter. Moreover, support connecting sides on two sides of the semi-open surround are used to wedge press the wedging plates of the antimagnetic cover fitted on the two sides thereof. Accordingly, when the swivel connector is joined to the adapter, the basis for maintaining contact positioning is achieved by the press contact terminal set and the receiving terminal set, as well as ensuring a perfect antimagnetic function.

The aforementioned semi-open surround is an elastic metal plate formed by bending.

The aforementioned support connecting sides symmetrically positioned corresponding to the wedging plates are respectively provided with indentations and protuberances able to mutually clasp.

The aforementioned support connecting sides symmetrically positioned corresponding to the wedging plates are respectively provided with linear clasping slots and clasping lips able to mutually clasp.

According to the present invention, a cover plate is provided on a surface of a corresponding opening of the upper portion of the mouth socket corresponding to another side of the movable connected device.

The external shape of a transverse cross section contour of the aforementioned press contact terminal set formed by the swivel connector is the same shape as plug connector terminals of standard specifications.

The shape of a transverse cross section contour of the aforementioned receiving terminal set of the adapter is the same shape as a female terminal plug socket of standard specifications.

According to the present invention, a clasping lip is provided at the position of an upper angled edge of a sloping surface at the front end of the mouth socket.

The aforementioned movable connected device is movable assembled to the side extension plates using a first pin connecting point provided on a connecting bar, and a second pin connecting point provided on the connecting bar is movable joined to the base of the swivel connector.

In order for the present invention to provide a plug set able to accommodate at least two types of female terminal specifications as well as respectively operate electrical connection, the plug set primarily uses a swivel method to achieve assembling and disassembling an electrical relationship between the adapter and the swivel connector. Moreover, the plug set provides a complete peripheral antimagnetic effect after assembling, and directly uses the antimagnetic components to affect a pairing operation and achieve a positional configuration.

The present invention uses the adapter provided with the mouth socket to outwardly mounted with the conversion terminal, and the interior of the mouth socket is horizontally mounted with the set of horizontally disposed terminals. The horizontally disposed terminals allow for electrical conduction to the conversion terminal. Moreover, the horizontally disposed terminals are enclosed by the semi-open surround, and the upper side is an upper opening. The swivel connector is swivel joined to the adapter, and the free end of the swivel connector is mounted with the surface connection terminals corresponding to the horizontally disposed terminals. The periphery of the surface connection terminals is surrounded by the antimagnetic cover. After assembling the swivel connector to the adapter, the surface connection terminals allow for electrical conduction to the horizontally disposed terminals. And a mechanical clasping action is achieved between the antimagnetic cover and the support connecting sides upwardly fitted to the two sides of the semi-open surround, which is used to achieve a positional configuration force between the swivel connector and the adapter. In addition, the complete peripheral antimagnetic effect is formed after interlocking the two.

According to the present invention, the cover plate is dock connected to the upper side of the mouth socket provided on the adapter, which, after assembling the swivel connector to the adapter, effectively press supports the swivel connector and prevents displacement thereof. When the adapter is not being used to connect to the swivel connector, assembling of the cover plate to the adapter forms a longitudinal socket, which enables a plug of general standard specifications to be longitudinally plugged therein.

The swivel connector of the present invention is assembled to the mouth socket of the adapter through the movable connected device using a swivel connection relationship. Wherein the movable connected device is further provided with the connecting bar, which is connected between the adapter and the swivel connector, and uses the interposition of the connecting bar to enable assembling the swivel connector in the moving path of the adapter, thereby achieving multiple angles of insertion into the mouth socket. And the upper side of the mouth socket can be further provided with a clasping lip to achieve a clasping and positioning function after assembly. The clasping lip causes the mouth socket to become a semi-open space, and after dismantling the swivel connector, the adapter can serve as an independent plug of general standard specifications enabling longitudinal plugging therein.

According to the present invention, after separating the swivel connector from the adapter, the swivel connector can be independently inserted into a general plug socket of standard specifications.

In order for the present invention to provide a plug set able to accommodate at least two types of female terminal specifications as well as respectively operate electrical connection, the plug set primarily uses a swivel method to achieve assembly and disassembly of the adapter and the swivel connector. After assembling, a complete peripheral antimagnetic effect is achieved, and directly uses the antimagnetic components to enable positional configuration. And after separating the adapter and the swivel connector, the two provide independent application.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
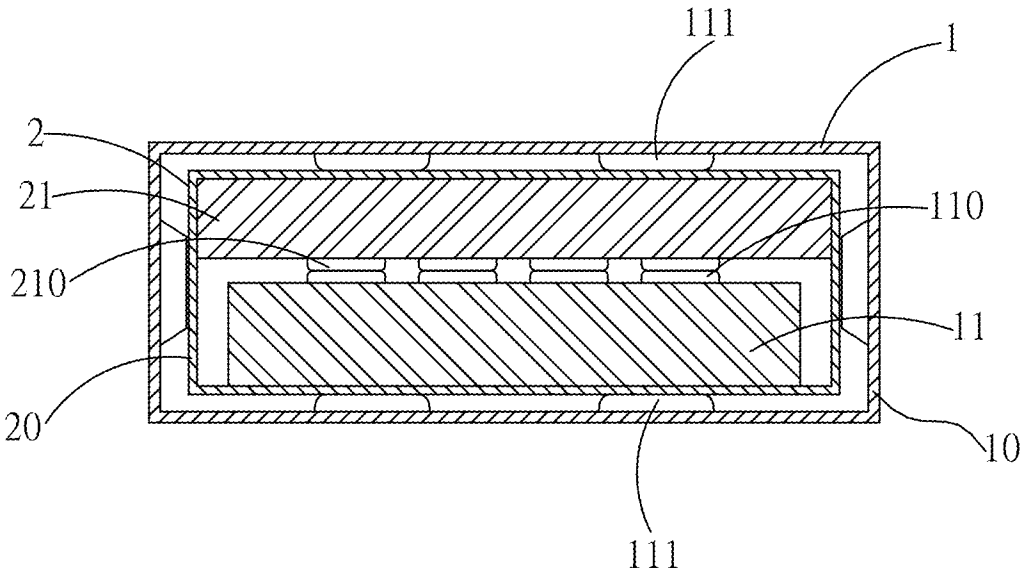
FIG. 1 Prior Art
FIG. 1 is a cutaway view depicting pairing relationship of terminals after assembling a USB connector according to the prior art.

The present invention provides a multipurpose, connection conversion plug assembly, and provides antimagnetic effectiveness when used with any connector such as a general USB connector. Portions of an adapter and a swivel connector of the plug assembly are respectively correspondingly provided with an upper opening and a lower opening. Moreover, two sides of an antimagnetic semi-open surround and wedging plates form the upper opening and the lower opening after assembly, and the mechanical clasping force from the two sides of the antimagnetic semi-open surround and the wedging plates is used to achieve a positional configuration between the the swivel connector and the adapter. And after separating the swivel connector from the adapter, the swivel connector can be used independently to plug into female terminals mounted on other information equipment. The interior of a mouth socket provided on the adapter forms a longitudinal socket, enabling an external male terminal connector of general specifications to plug therein, after which a conversion terminal mounted on the adapter is used to enable conversion into different connector specifications. And the upper side of the mouth socket is provided with an openable cover plate. The cover plate is able to provide subsidiary pressing to augment the positioning of the swivel connector. In addition, when the adapter is not assembled to the swivel connector, assembly of the cover plate to the mouth socket can form a female terminal socket of regular specifications, enabling other connectors of standard specifications to be plugged therein. In principle, after separating the swivel connector from the adapter, a user can independently use the adapter and the swivel connector and enable the adapter and the swivel connector to be independently used.

The swivel connecting method between the aforementioned adapter and the swivel connector can be further adopted to use a connecting bar to vary the movement of the swivel connector toward the adapter during the connecting process, thus achieving multi-angular position path movement. Furthermore, the mouth socket can be of semi-open form, which enables the interior of the mouth socket to independently form a female terminal socket of regular specifications, and, through the conversion terminal mounted on the adapter, convert into specifications for different external connectors, thereby providing a design with multiple applications.

After assembling the main body of the present invention, the antimagnetic components enable a positioning effect. And the cover plate set up on the upper side of the mouth socket can effectively press down on the swivel connector after entering the adapter, thereby providing positioning assistance. Moreover, interposition of the cover plate enables the horizontally disposed terminals of the adapter to form a female terminal socket of general specifications. In addition, the interposition of the connecting bar is used to vary the movement of the swivel connector toward the adapter during the connecting process, thus achieving a multi-angular insertion positioning movement. Moreover, the mouth socket of the adapter is provided with a clasping lip, which enables the mouth socket to be of semi-open form, and after the swivel connector enters the adapter, the lower edge of the clasping lip affects a clasp positioning function. After separating from the swivel connector, the clasping lip, corresponding to the horizontally disposed terminals, is able to surround and form a female terminal socket of general specifications for use thereof.

Figure 2:
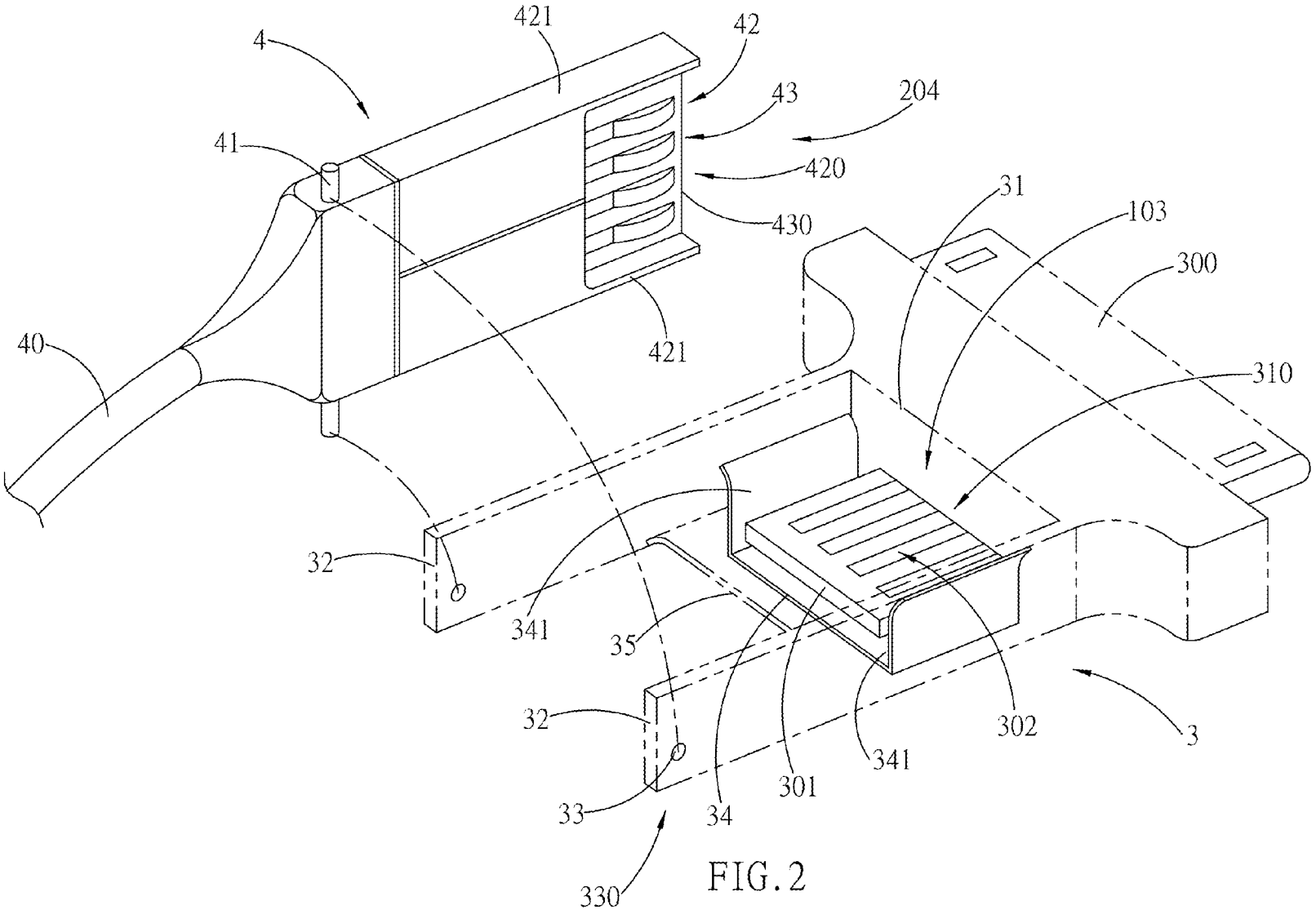
FIG. 2 is a reciprocal diagram of a basic structure of an adapter and a swivel connector of the present invention.

Regarding the detailed structure and operating principle of the present invention, please refer to the description of the drawings as follows: Referring first to FIG. 2, (to facilitate explanation, the description of the present invention uses an information USB connector as an example) the present invention is assembled to one end of a cable 40, and functions as a plug set to provide electrical connection for the end of the cable 40. Wherein, one end of the cable 40 is first assembled to a swivel connector 4, and the swivel connector 4 is movable assembled to an adapter 3 through a movable connected device 330. The swivel connector 4 is thus able to enter a mouth socket 31 of the adapter 3 using a swiveling method. The interior of the mouth socket 31 is mounted with sequenced horizontally disposed terminals 302 to form a receiving terminal set 103. The free end of the swivel connector 4 is mounted with sequenced surface connection terminals 43 to form a press contact terminal set 204. The receiving terminal set 103 and the press contact terminal set 204 are able to affect surface press contact through the function of the movable connected device 330, thereby enabling electrical conduction from the cable 40 to be transferred to a conversion terminal 300. The base of the swivel connector 4 is further provided with movable connecting bars 41, which are respectively assembled in movable connecting apertures 33 provided in side surfaces of side extension plates 32 extending from the rear of the mouth socket 31. After assembling, the swivel connector 4 is able to swivel relative to the adapter 3.

The free end of the swivel connector 4 is provided with a π-shaped semi-covering antimagnetic cover 42. A bedplate 430 covers the antimagnetic cover 42, and the surface connecting terminals 43 form the complete press contact terminal set 204. The antimagnetic cover 42 is provided with a lower opening 420 corresponding to the connecting surface of the surface connecting terminals 43, and two sides of the antimagnetic cover 42 respectively form wedging plates 421, and the measurements of the shape of the entire cross section contour are the same as those of a male terminal connector of standard specifications.

The adapter 3 is provided with the mouth socket 31, and the interior of the mouth socket 31 is mounted with the receiving terminal set 103 corresponding to the position of the surface connecting terminals 43 of the swivel connector 4. The receiving terminal set 103 is formed from the plurality of sequenced horizontally disposed terminals 302, and the horizontally disposed terminals 302 are supported by a cantilevered tongue 301. The cantilevered tongue 301 is of cantilever form, and an U-shaped semi-open surround 34 having an antimagnetic function is positioned below the cantilevered tongue 301 so as to provide an interspace therebetween. Support connecting sides 341 upwardly extend from two sides of the semi-open surround 34. The span between the two support connecting sides 341 is able to cover the width between the wedging plates 421 on the two sides of the swivel connector 4. Moreover, the support connecting sides 341 provide an elastic wedging press effect, which is able to wedge press the wedging plates 421 to form a mechanical frictional positioning force. A support tray 35, positioned corresponding to the adapter 3, is provided below the bottom surface of the semi-open surround 34, and functions to provide protection to the bottom portion. And another end of the adapter 3 is mounted with the conversion terminal 300, and the interior of the conversion terminal 300 is similarly mounted with a plurality of connecting terminals (not shown in the drawings), which allow for electrical conduction to the horizontally disposed terminals 302. The basic interconnecting principle achieves electrical conduction from the cable 40 passes through the surface connecting terminals 43 and into the horizontally disposed terminals 302 that are in press contact therewith, after which electrical conduction is transferred to the conversion terminal 300. Wherein the specifications of the swivel connector 4 are different from those of the conversion terminal 300.

Figure 3:
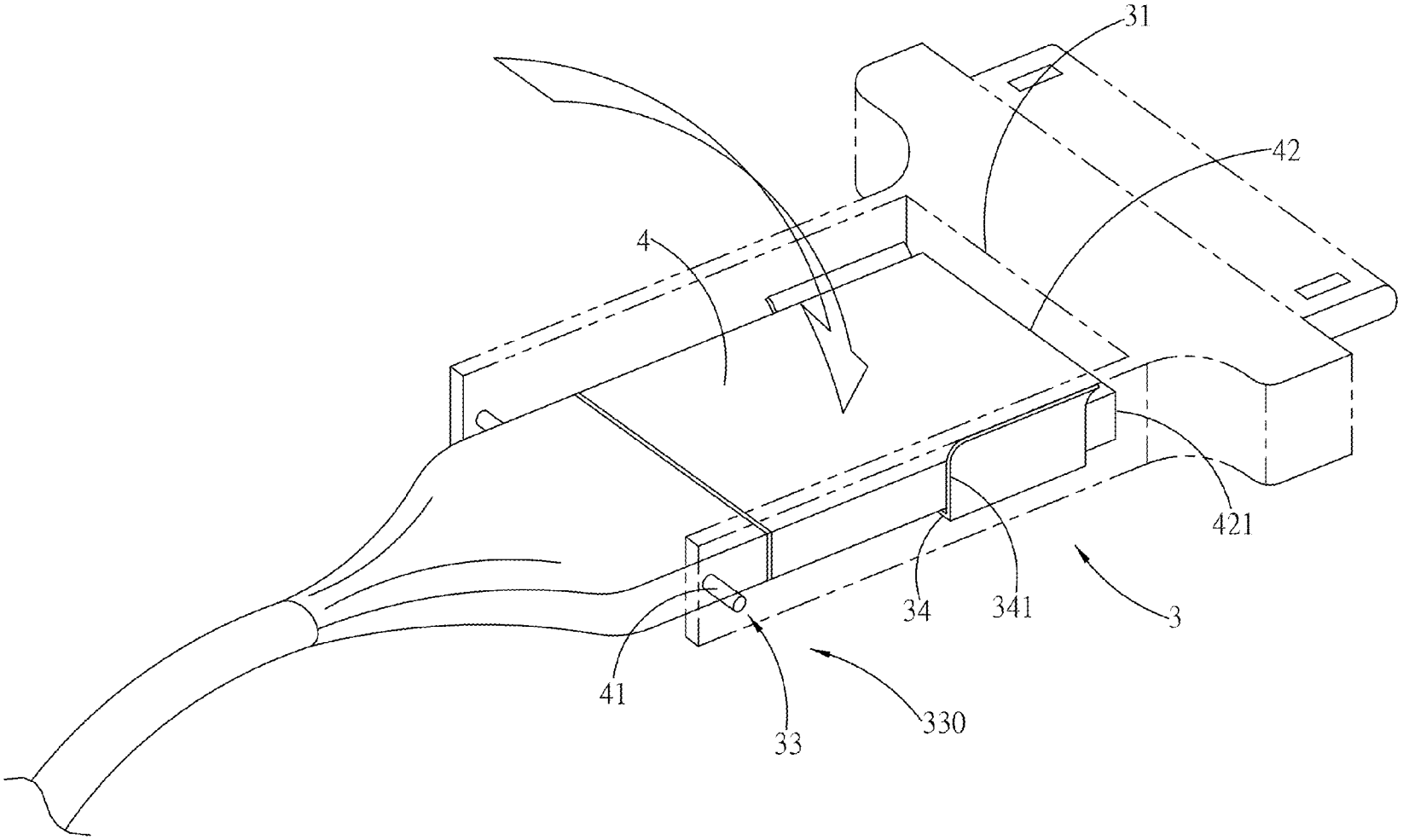
FIG. 3 is an external schematic view of the swivel connector assembled to the adapter according to the present invention.

Referring to FIG. 3. (together with FIG. 4), when the swivel connector 4 is swiveled towards the direction of the mouth socket 31 of the adapter 3 and wedged therein through the function of the movable connected device 330, then the wedging plates 421 of the antimagnetic cover 42 fitted to the swivel connector 4 are wedged in by the support connecting sides 341 on two sides of the semi-open surround 34. Moreover, the support connecting sides 341 are metal pieces, which are easily made to have resilience, and thus effectively fix the surfaces of the wedging plates 421 on the two sides of the antimagnetic cover 42 to form a mechanical and frictional wedge pressing combination force. In addition, any concave-convex clasping points (not shown in the drawings) can also be configured on corresponding positions of the wedging plates 421 or the support connecting sides 341 after assembling, thereby similarly affecting wedge positioning of the swivel connector 4 after assembling. Accordingly, wedge positioning is achieved through the mutual action of support connecting sides 341 and the wedging plates 421. The swivel connector 4 is thus difficult to come apart from the adapter 3, moreover, a complete peripheral antimagnetic covering is formed between the fitted antimagnetic cover 42 and the wedging plates 421 and the semi-open surround 34 and the support connecting sides 341, preventing magnetic conduction through the terminals, which would affect electrical conduction.

Figure 4:
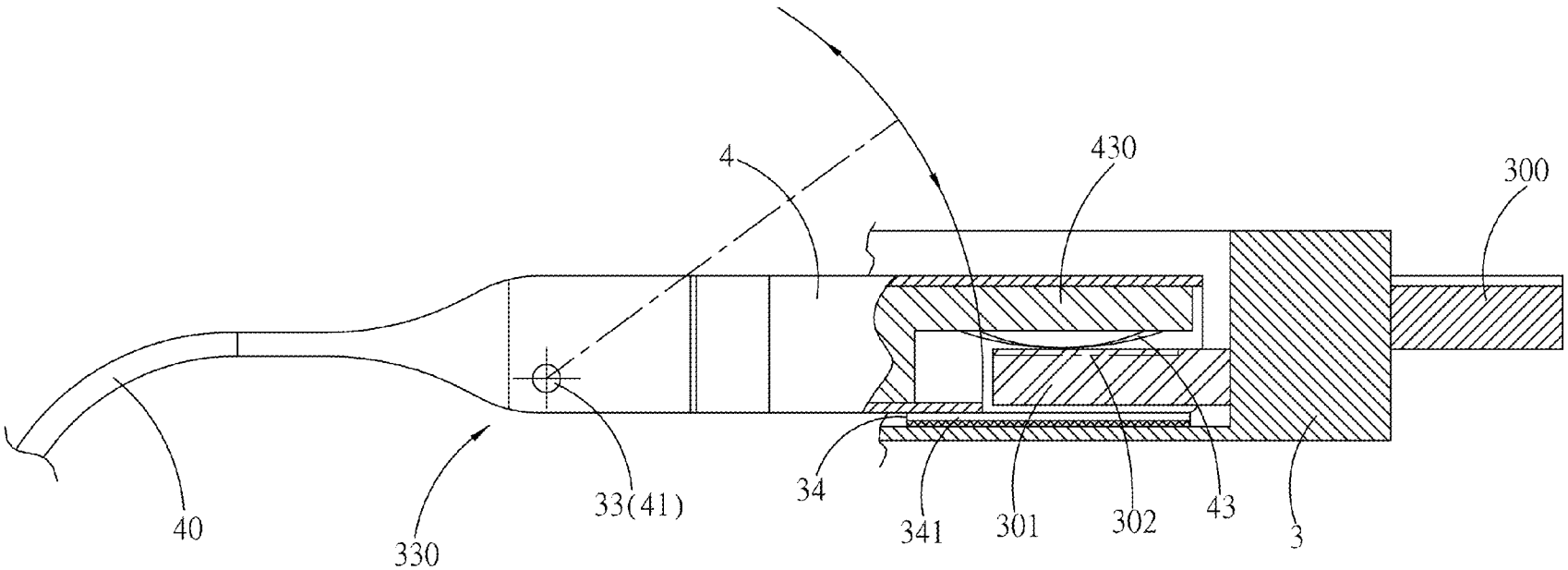
FIG. 4 is a cutaway view of the electrical connection relationship of the swivel connector assembled to the adapter according to the present invention.

Referring to FIG. 4, the swivel connector 4 is swivel combined to the adapter 3 through the movable connected device 330, and the movable connected device 330, using the movable connecting apertures 33 and the movable pin connecting function of the movable connecting bars 41, enables the swivel connector 4 to swivel through a radius according to the length thereof. After assembling as depicted in FIG. 3, the surface connecting terminals 43 mounted on the bedplate 430 are able to press contact the horizontally disposed terminals 302 mounted on the upper surface of the cantilevered tongue 301 of the adapter 3, thereby allowing for electrical conduction therebetween. After affecting electrical conduction with the conversion terminal 300 from the cable 40 through the surface connecting terminals 43 in contact with the horizontally disposed terminals 302, the conversion terminal 300 is able to function as an electrical connector with female terminals of other specifications.

After separating the aforementioned swivel connector 4 from the adapter 3, the swivel connector 4 is able to independently function as a connector with general specifications such as an USB connector, and plug into other equipment, such as an USB plug socket on a computer casing.

The receiving terminal set 103 mounted in the interior of the mouth socket 31 provided on the adapter 3 (see FIG. 2) is semi-open covered by the U-shaped semi-open surround 34 and the support connecting sides 341, and is able to function independently as a female terminal socket of regular specifications, enabling other USB male terminal connectors of other standard specifications to be plugged therein. After assembling the receiving terminal set 103 in the semi-open surround 34, the transverse cross section contour shape of the interposing space is similar to the cross section of a standard female terminal socket. In addition, the periphery of a general USB connector of standard specifications is provided with the antimagnetic surround 20 to function as antimagnetic protection. Hence, after connecting the cantilevered tongue 301, as depicted in FIG. 4, without regard for the support connecting sides 341 and the antimagnetism of the semi-open surround 34, the clamp connecting effect of the support connecting sides 341 can still function as a ground conductor to affect potential electrical conduction. Moreover, the interspace formed between the support connecting sides 341 and the lower edge of the cantilevered tongue 301 enables a male terminal connector of standard specifications to penetrate therein and form a solid angular positioning. Accordingly, the adapter 3 can form an independent female terminal connector, enabling an external USB connector of standard specifications to connect therein and allow for electrical conduction to the conversion terminal 300, thereby providing the adapter 3 with multi-functional use.

Figure 5:
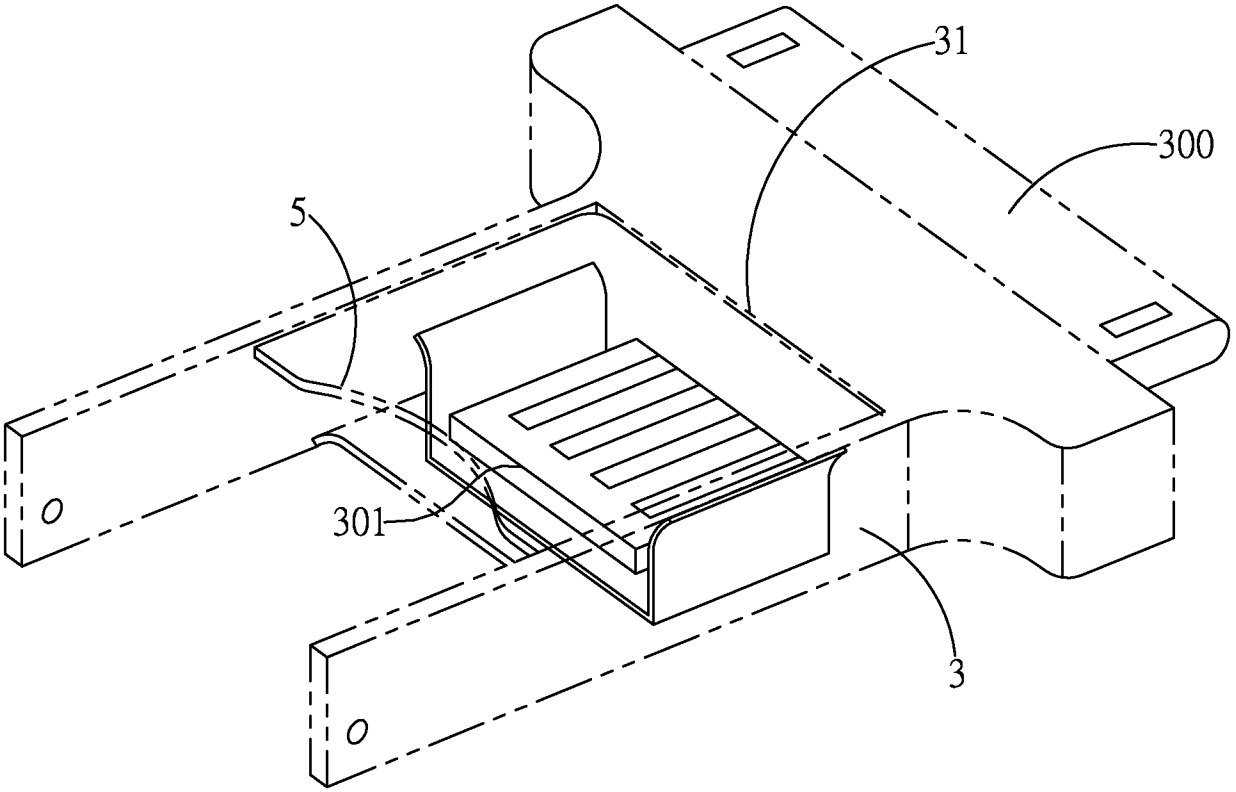
FIG. 5 is an external schematic view of a region of a mouth socket of the adapter provided with a cover plate according to the present invention.

The present invention provides another design concept using a cover plate 5 (as shown in FIG. 5). The cover plate 5 can be assembled using any method and combined to the upper side of the mouth socket 31. The primary use of the cover plate 5 is to vertically cover the upper side of the cantilevered tongue 301. In addition, the assembling method of the cover plate 5 can adopt a sliding motion or an inserting connection or a docking connection method. A description of the present embodiment uses a docking connection method as an example thereof, whereby the cover plate 5 is assembled to the upper side of the mouth socket 31 using a transverse docking connection method toward the front end of the conversion terminal 300, thus correspondingly covering the area vertically above the cantilevered tongue 301. The cover plate 5 can be upturned to enable assembly of the adapter 3, which is then covered with the cover plate 5. And the aforementioned sliding motion or inserting connection method to assemble the cover plate 5 uses a similar upturning and covering motion.

Figure 6:
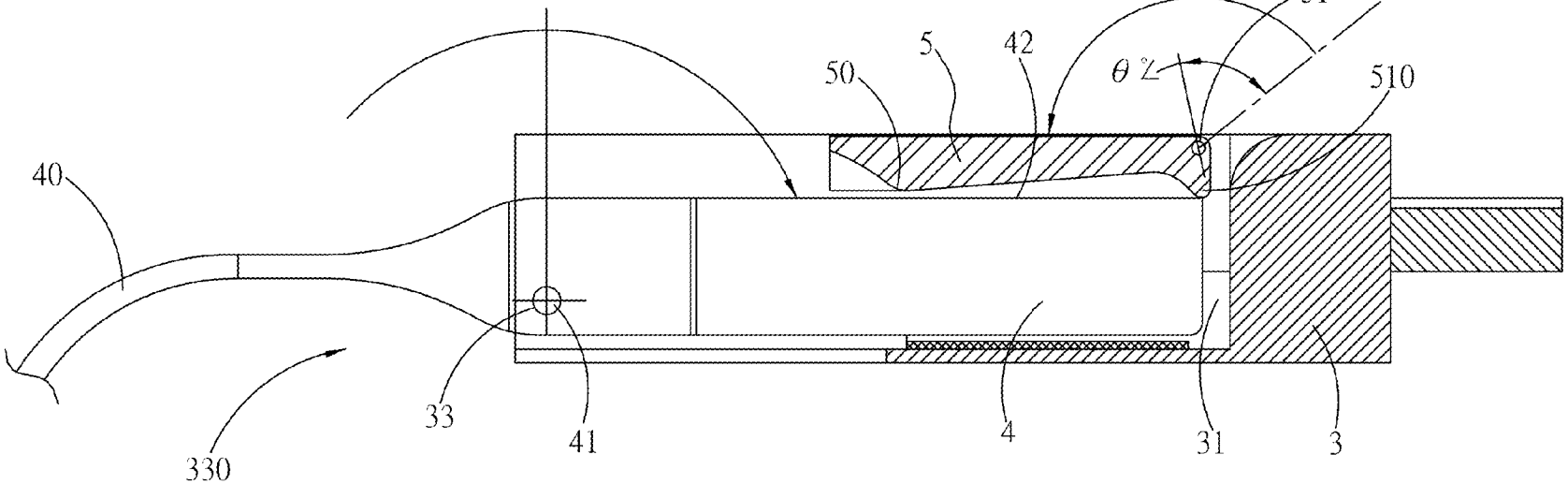
FIG. 6 is a schematic view of the cover plate acting on the upper surface of the swivel connector.

Referring to FIG. 6, apart from use as a covering, after assembling the swivel connector 4 to the adapter 3, the function of the cover plate 5 can use a top point 510 and a lower press edge 50 on the front and rear of the cover plate 5 respectively to press down on the upper surface of the antimagnetic cover 42 of the swivel connector 4. Wherein, in particular the top point 510 uses a deflection means of a cam as a top point, and the swivel radius of the cover plate 5, after assembling to pivot shafts 51, exceeds that of the height distance of the antimagnetic cover 42. Hence, use is made of the pivot connection of the pivot shafts 51 to downward press and swivel the cover plate 5. After which, by pressing downward vertically backward, the top point 510 causes the lengthwise body of the cover plate 5 to be horizontally pressed down on the upper surface of the antimagnetic cover 42. Moreover, the force is distributed to the lower press edge 50, causing the cover plate 5 to achieve two point pressure on the upper surface of the antimagnetic cover 42. When a user wants to separate the swivel connector 4, then the cover plate 5 is lifted up towards the rear to open up a space that enables the swivel connector 4 to swivel out.

Figure 7:
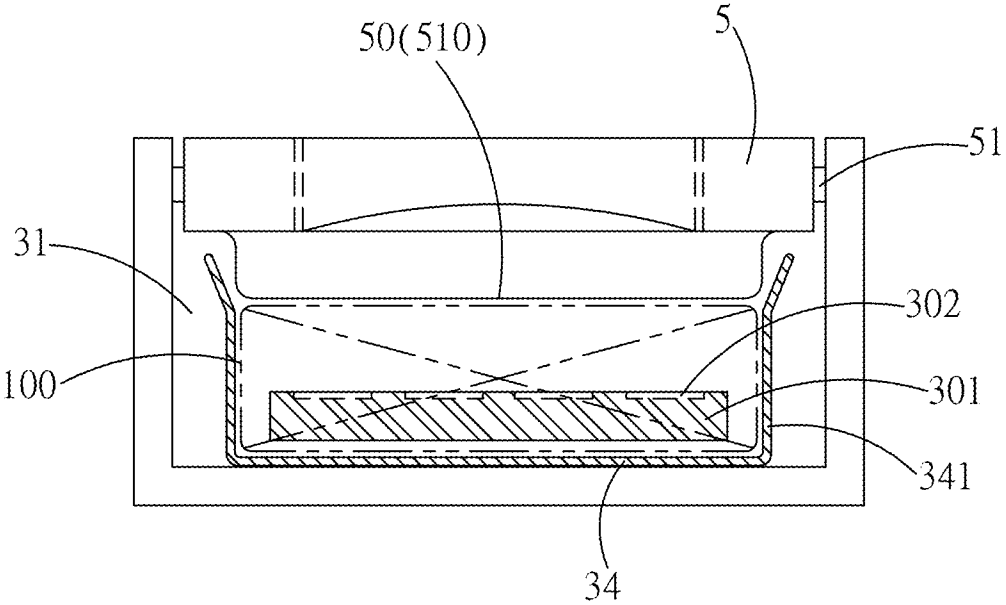
FIG. 7 is a cutaway schematic view of a socket formed in the interior of the adapter after covering with the cover plate according to the present invention.
Figure 8:
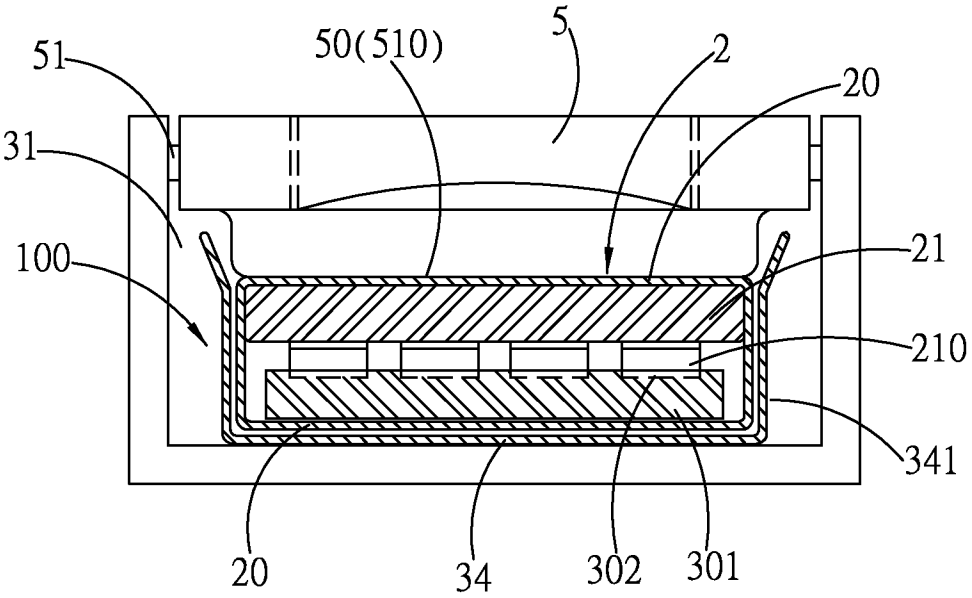
FIG. 8 is a schematic view depicting longitudinally insert/extract assembly of a male terminal connector of regular specifications after covering with the cover plate according to the present invention.
Figure 9:
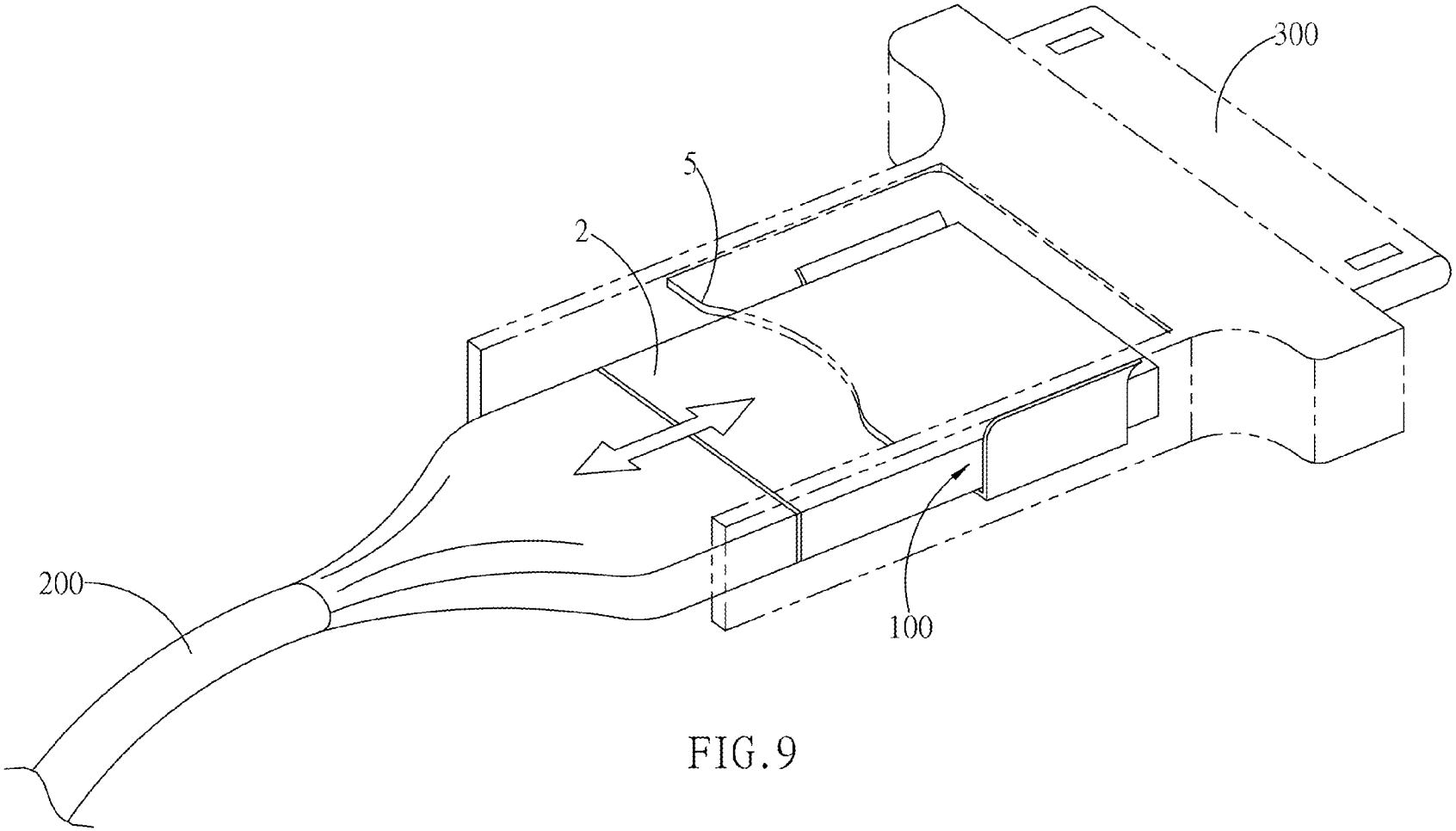
FIG. 9 is a transverse side view depicting the assembly relationship after connecting a USB connector to the socket providing regular standard specifications formed after covering the adapter with the cover plate according to the present invention.

Referring to FIGS. 7, 8 and 9, regarding the design of the aforementioned mouth socket 31 provided with the cover plate 5, the cover plate 5 is dock connected to the upper side of the mouth socket 31 toward one side of the conversion terminal 300 using the pivot shafts 51. After covering with the cover plate 5 using a downward motion thereof, the lower press edge 50 and the top point 510 are at fixed point positions. The fixed point positions enable a socket 100 to be formed within the surrounding space formed by the semi-open surround 34 and the support connecting sides 341. The interior of the surrounding space comprises the cantilevered tongue 301 and the horizontally disposed terminals 302. The socket 100 thus enables other external general USB connectors of standard specifications to longitudinally connect therein (as shown in FIG. 8). The general male terminal connector 2 of standard specifications is also able to affect a front-rear longitudinal insert/extract assembly configuration after covering with the aforementioned cover plate 5, thereby enabling electrical conduction from a cable 200 and transmission to the conversion terminal 300 after assembling the socket 100.

Referring to FIG. 8, as depicted in the drawing, after forming the socket 100 and then plugging in the external male terminal connector 2 of standard specifications, then the contact terminals 210 and the periphery of the horizontally disposed terminals 302 are covered by the antimagnetic surround 20. The lower surround of the antimagnetic surround 20 is supported by the bottom edge of the cantilevered tongue 301. Accordingly, the force formed enables the contact terminals 210 to press down on the horizontally disposed terminals 302 on the upper surface of the cantilevered tongue 301, thus achieving a qualitative assembly. And the upper surface of the antimagnetic surround 20 is subjected to the pressing effect of the lower press edge 50 or the top point 510, thereby achieving a frictional force that makes it difficult for the male terminal connector 2 to be detached.

The cover plate 5 is assembled to the position of the mouth socket 31 using the pivot shafts 51. The symmetrical positions of the cover plate 5 and the mouth socket 31 after covering with the cover plate 5 can be provided with any mutual clasping structure such as concave-convex clasping protuberances or clasping indentations-protuberances (not shown in the drawings) to affect instant fixed clasping. Hence, when not in use, the lower press edge 50 or the top point 510 is able to form the socket 100 relative to the space of the cantilevered tongue 301 in preparation for an external USB male connector of standard specifications to be plugged therein. And the aforementioned concave-convex mutual clasping structure can be a mutual clasping structure using linear clasping slots and clasping lips.

Figure 10:
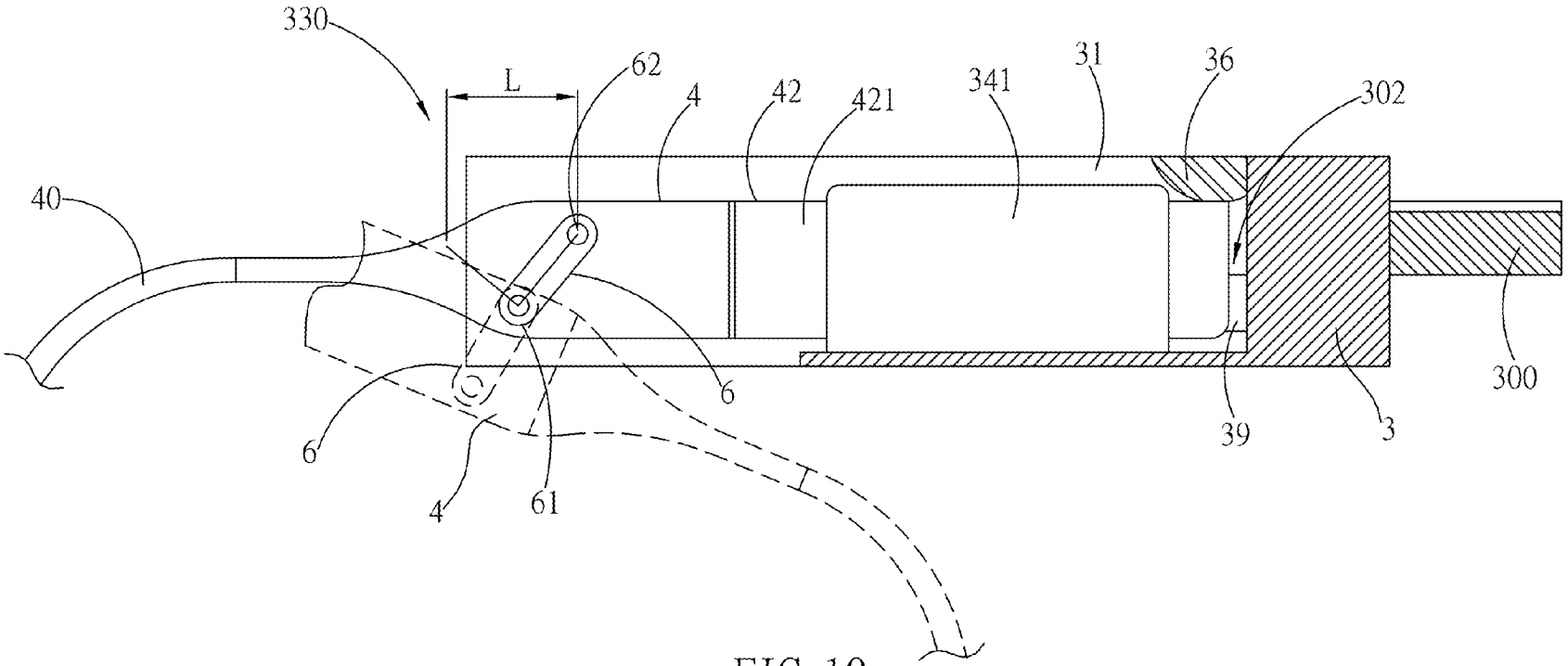
FIG. 10 is a schematic view depicting a movable connected device using a connecting bar provided thereon to indirectly movable connect to the adapter according to the present invention.

Referring to FIG. 10, the swivel relationship between the swivel connector 4 and the adapter 3 provided by the present invention is realized through the movable connected device 330 dock connected to the rear end of the adapter 3. Wherein the movable connected device 330 can be connected between the adapter 3 and the swivel connector 4 using the interposition of a connecting bar 6. Wherein first pin connecting points 61 at one end of the connecting bar 6 are movable connected to the adapter 3, and second pin connecting points 62 at the other end of the connecting bar 6 are movable connected to an area of the swivel connector 4. And the swivel radius of the connecting bar 6 is used to enable horizontal lifting up or pressing down of the swivel connector 4 relative to the adapter 3, or the pin connected relationship of the second pin connecting points 62 is used to enable the swivel connector 4 to move in and out of the mouth socket 31 with a L-swivel movement, the angle of which is able to freely vary, thus forming a multi-angle insertion action into the adapter 3. Wherein a region of the adapter 3 is similarly provided with the support connecting sides 341, and a wedge pressing means is similarly used to fixedly fasten the wedging plates 421 of the antimagnetic cover 42, thereby achieving assembly of the swivel connector 4 to the adapter 3, thus achieving combination positioning thereof. After separating the swivel connector 4 from the adapter 3, a conventional structure is formed which can be used as an independent male terminal connector.

A clasping lip 36 is provided at one end of the mouth socket 31 close to one side of the conversion terminal 300. The clasping lip 36 can eaves-like partially seal the position vertically above the cantilevered tongue 301 (see FIG. 2), thus causing the upper opening 310 of the cantilevered tongue 301 to become a semi-open form. The lower edge of the clasping lip 36 enables inserting the front end of the antimagnetic cover 42 at an oblique angle. And after inserting, the lower edge of the clasping lip 36 is used to wedge press the upper surface at the front end of the antimagnetic cover 42, causing the contact terminals (not shown in the drawings) mounted in the interior of the antimagnetic cover 42 to effectively press in the direction of the horizontally disposed terminals 302 of the cantilevered tongue 301. The clasping lip 36 can eaves-like vertically obstruct the front end of the horizontally disposed terminals 302, thereby enabling the extent of the space in the upper half portion of the mouth socket 31 (the opening 310) to be of semi-open form. And the lower edge of the clasping lip 36 is provided with a clasping capacity, which enables wedge holding of the wedging plates 421 provided on the swivel connector 4 to achieve an instant positioning operation.

Figure 11:
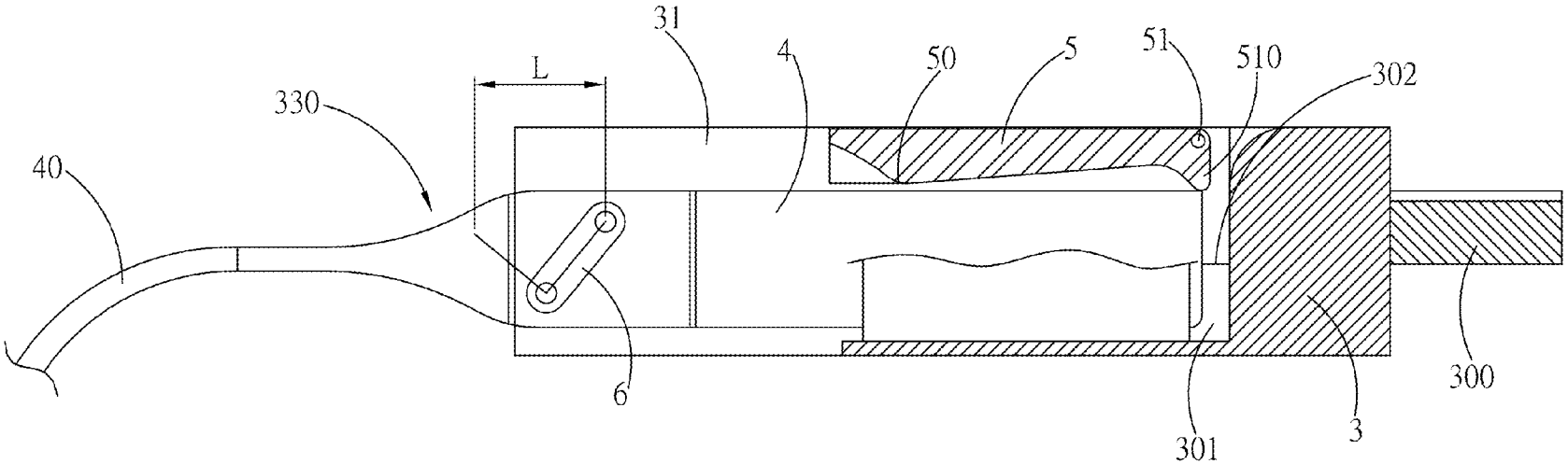
FIG. 11 is a side schematic view depicting the upper side of the adapter covered with the cover plate after assembling the swivel connector to the movable connected device fitted with the connecting bar according to the present invention.

Referring to FIG. 11, the cover plate 5 is dock connected to the upper side opening of the mouth socket 31 close to one side of the conversion terminal 300. The cover plate 5 is able to function as an upper surface press connection with the swivel connector 4 swivel inserted in the movable connected device 330. Through interposition of the connecting bar 6, the movable connected device 330 enables the swivel connector 4 to achieve a multi-angle positioning action that realizes oblique insertion assembly into the mouth socket 31 of the adapter 3. Similarly, the cover plate 5 is provided with the lower press edge 50 and the top point 510 to achieve a two-point locking press effect and press assemble onto the upper surface of the swivel connector 4 to enable the swivel connector 4 to forcefully press the horizontally disposed terminals 302 mounted on the cantilevered tongue 301, and allow for electrical conduction thereto. Accordingly, electrical signals from the cable 40 are transmitted to the conversion terminal 300.

As depicted in the aforementioned FIG. 10. and FIG. 11, after separating the swivel connector 4, the male terminal connector 2 is formed on the region of the cantilevered tongue 301, as depicted in FIG. 8, enabling an external USB connector of standard specifications to longitudinally connect therein. Moreover, apart from the pivot shafts 51 dock connecting to the adapter 3, after covering the mouth socket 31 with the cover plate 5, the corresponding surface positions at the free end of the cover plate 5 respectively provide a concave-convex clasping relationship, which is able to realize instant clasp positioning after covering with the cover plate 5. After the clasp positioning, the socket 100 formed is able to satisfy the requirements for other external USB connectors of general specifications to plug therein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A plug set provided with spatial variation, comprising: an adapter, wherein the adapter is provided with a mouth socket, and an interior of the mouth socket is provided with a cantilevered tongue, an upper surface of the cantilevered tongue is mounted with a plurality of horizontally disposed terminals, and an U-shaped antimagnetic semi-open surround is positioned below the cantilevered tongue such that an interspace is provided therebetween, thereby forming a receiving terminal set; a conversion terminal is mounted external of the mouth socket, wherein, the conversion terminal allows for electrical conduction to the horizontally disposed terminals; a swivel connector, wherein, one end of the swivel connector is connected to a cable, a free end of the swivel connector is mounted with a plurality of surface connecting terminals able to provide for contact connection to the horizontally disposed terminals, and the surface connection terminals allow for electrical conduction to the cable, an periphery of an upper portion of the surface connection terminals is covered by a π-shaped antimagnetic cover to form a press contact terminal set, two sides of the antimagnetic cover are wedging plates; a movable connected device, wherein, ends of side extension plates extending from the mouth socket enable the movable connected device to movable connect to a base of the swivel connector, thereby enabling the swivel connector to perform a swivel motion to allow assemble to and disassemble from the mouth socket of the adapter, and support connecting sides on two sides of the semi-open surround are used to enable wedge pressing of the wedging plates fitted on the two sides of the antimagnetic cover, thereby achieving a basis to enable the press contact terminal set and the receiving terminal set to maintain contact connection positioning after combining the swivel connector to the adapter, such that a complete peripheral antimagnetic effect is provided.

2. The plug set provided with spatial variation according to claim 1, wherein, that the semi-open surround is an elastic metal plate formed by bending.

3. The plug set provided with spatial variation according to claim 1, wherein, symmetrical corresponding positions between the support connecting sides and the wedging plates are respectively provided with indentations and protuberances able to mutually clasp.

4. The plug set provided with spatial variation according to claim 1, wherein, symmetrical corresponding positions between the support connecting sides and the wedging plates are respectively provided with linear clasping slots and clasping lips able to mutually clasp.

5. The plug set provided with spatial variation according to claim 1, wherein, an opening in the upper side of the mouth socket is provided with a cover plate relative to another side of the movable connected device.

6. The plug set provided with spatial variation according to claim 1, wherein, the external transverse contour cross section shape of the press contact terminal set mounted on the swivel connector is the same shape as plug connection terminals of standard specifications.

7. The plug set provided with spatial variation according to claim 1, wherein, the transverse cross section contour shape of the receiving terminal set of the adapter is the same shape as a female terminal socket of standard specifications.

8. The plug set provided with spatial variation according to claim 1, wherein, a clasping lip is provided at the position of an upper angled edge of a sloping surface at the front end of the mouth socket.

9. The plug set provided with spatial variation according to claim 1, wherein, the movable connected device is movable assembled to the side extension plates using first pin connecting points provided on a connecting bar, and second pin connecting points provided on the connecting bar are movable assembled to the base of the swivel connector.

* * * * *